United States Patent [19]

Coggins et al.

[11] 4,157,651

[45] Jun. 12, 1979

[54] METHOD AND MEANS FOR SEPARATELY COLLECTING CLOSED TOE STOCKINGS AND WASTE THEREFROM

[75] Inventors: Sherrill B. Coggins; James R. Lewis, both of Winston-Salem; Orlice A. Speas, Rural Hall, all of N.C.

[73] Assignee: Speizman Industries, Charlotte, N.C.

[21] Appl. No.: 791,340

[22] Filed: Apr. 27, 1977

[51] Int. Cl.[2] ..... D04B 35/34; D04B 15/92

[52] U.S. Cl. ..... 66/147; 66/149 S

[58] Field of Search ..... 66/147, 149 R, 149 S, 66/150; 83/98, 99, 100

[56] References Cited

U.S. PATENT DOCUMENTS

| | | | |
|---|---|---|---|
| 3,273,360 | 9/1966 | Mahler | 66/149 S |
| 3,426,552 | 2/1969 | Baird | 66/149 R |
| 3,550,402 | 12/1970 | Colton | 66/147 |
| 3,756,044 | 9/1973 | Grizzle | 66/147 |
| 3,800,559 | 4/1974 | Fecker | 66/147 X |
| 4,033,151 | 7/1977 | Jansen | 66/147 |
| 4,069,090 | 1/1978 | Boyer | 66/26 X |

*Primary Examiner*—Wm. Carter Reynolds
*Attorney, Agent, or Firm*—Richards, Shefte and Pinckney

[57] ABSTRACT

Method and apparatus for separating and separately collecting stockings and toe end waste therefrom, incorporated with a toe end closing apparatus for a circular knitting machine where the stocking is gathered in a clamp at the toe end and closed thereat, with a short waste end portion being severed therefrom by the closing operation, and including a movable stop for the clamp actuator to stop clamp opening at a partially open position to retain the entirety of the waste end temporarily while the stocking is conventionally sucked away from the clamp through a conduit to a collection station, after which the stop is moved to allow full opening of the clamp for release of the waste end into the suction current created by an air jet temporarily blowing across the conduit for transporting the entirety of the waste end in fabric form to a separate waste collection station.

6 Claims, 10 Drawing Figures

METHOD AND MEANS FOR SEPARATELY COLLECTING CLOSED TOE STOCKINGS AND WASTE THEREFROM

BACKGROUND OF THE INVENTION

The present invention relates to a method and means for separately collecting tubular knit stockings and the waste ends therefrom after the stocking toe ends have been automatically closed in a manner that produces a short waste portion having been severed from the toe end of the stocking. A method and apparatus for closing the ends of tubular knit stockings by heat setting with a resulting severing of a short end of waste therefrom is disclosed in Boyer U.S. Pat. No. 4,069,090 which discloses clamps gathering the stocking fabric into a radially constricted substantially solid mass near the toe end of the stocking tube, and a hot severing and sealing element passing through the constricted fabric within the clamp to close the toe end and thereby sever a short piece of waste material at the toe end. After the severing and sealing operation, the aforesaid patent discloses that the clamp is opened to allow the closed end stocking and the waste to be sucked away to a collection station by a suction air current applied to the conduit conventionally located below the circular knitting head and the toe end closing clamp.

While the Boyer patent discloses an efficient and economical way of forming closed ends on tubular knit stockings, the stockings and waste end portions are collected together at the collection station, and they must be separated at a subsequent manual operation. Conventionally, the stockings and waste fabric would be collected together in bags in which they would be contained during further handling as during dyeing and drying operations, and subsequent tedious separation of the waste fabric from the stockings is required. Not only is the subsequent separating requirement a costly and time consuming disadvantage, but the small, button-like, heat-sealed portions of the waste fabric will rub on the fabric of the stockings during tumbling agitation or other manipulation during subsequent treatment, causing abrasions, picks and other defects, and the tail yarns on the waste fabric will snarl in or become entangled with the stockings during such manipulation and cause problems in the subsequent separation of the waste fabric from the stockings.

In contrast, the method and means of the present invention as more fully explained hereinbelow, provide a simple, efficient, reliable, and effective method and means for separating the closed end stockings from the waste fabric thereof immediately after severing so that the stockings will be treated separately from that point on without any opportunity for the waste fabric to damage the stockings or become entangled therewith. The stockings are collected in a container for handling through further operations, and the waste ends are collected in a container from which appropriate disposal may be made, thereby eliminating quality defects in the stockings, and also eliminating expensive manual operations in separating the waste from the stockings.

SUMMARY OF THE INVENTION

Briefly described, the method of the present invention for separately collecting closed toe stockings and the waste separate therefrom that has been severed therefrom during a clamping and severing operation includes releasing a severed stocking from the clamping and severing operation while temporarily retaining the entirety of the waste fabric, remotely collecting the released stocking at a stocking collection location, and then releasing the entirety of the waste fabric and remotely collecting it in fabric form at a waste collection location separate from the stocking collection location.

Preferably, the severed stocking is released by reversing the clamping operation sufficiently to release the stocking while not sufficiently to release the entirety of the waste, and the waste is released by continuing the reversing of the clamping operation sufficiently to release the waste. The clamping and severing operation is preferably performed on a circular knitting machine with the stocking depending from its toe end and the waste fabric disposed thereabove, and suction is applied through a conduit through which both the stocking and waste fabric are drawn by the suction to advance the released stocking and waste fabric from the clamping and severing operation for discharge of the stocking and entirety of the waste fabric in fabric form from different outlets on the conduit.

In its preferred embodiment, the method of the present invention includes clamping a stocking having a thermoplastic toe portion at the toe portion thereof laterally in radial constriction by closing constriction clamps, and severing the toe portion from the waste fabric at the constriction with a heated element that closes the stocking toe end by heat setting, partially opening the clamps to release the closed toe stocking while retaining the waste fabric thereat, transporting the closed toe stocking from the clamps through a conduit to a stocking collection location, fully opening the clamps to release the waste fabric, and transporting the waste fabric from the clamps through the conduit and ejecting the waste fabric therefrom into a waste collection station by an air jet directed laterally across the conduit toward the waste collection station, wherein the air jet directed across the conduit creates a suction draft in the conduit for transport of the waste fabric from the clamps.

Briefly described, the means of the present invention for separately collecting closed toe stockings and the waste fabric separated thereform severed therefrom during a clamping and severing operation includes means for releasing a severed stocking from the clamping and severing operation while temporarily retaining the entirety of the waste fabric, means for remotely collecting the released stocking at a stocking collection location, means for releasing the entirety of the waste fabric, and means for remotely collecting the released entirety in fabric from at a waste collection location separate from the stocking collection location.

Preferably, the means for releasing a severed stocking includes means for reversing the clamping operation sufficiently to release the stocking, while not sufficiently to release the waste fabric, and the means for releasing the entirety of the waste fabric includes means for continuing the reversing of the clamping operation sufficiently to release the entirety. The clamping and severing operation is preferably performed on a circular knitting machine while the stocking depends from its toe end with the waste fabric disposed thereabove, and the means for remotely collecting stockings and waste fabric include means applying suction through a conduit to advance the released stocking and the entirety of the fabric from the clamping and severing operation through the conduit for drawing the stocking and waste fabric to a means for discharging the stocking and the entirety of the waste fabric in fabric form from different outlets on the conduit.

The preferred embodiment of the means of this invention includes constriction clamps for clamping a stocking having a thermoplastic toe portion thereat laterally in radial constriction, means for severing the toe portion from the waste fabric at the constriction and including a heated blade that closes the stocking toe end by heat setting, means for partially opening the clamps to release the stocking toe while retaining the waste thereat, means for transporting the closed toe stocking from the clamps and including a conduit through which the stocking is transported to a stocking collection station, means for fully opening the clamps to release the waste fabric, and means for transporting the waste fabric from the clamps through the conduit to a waste collection station including air jet means directed laterally across the conduit toward the waste collection station for creating a suction draft in the conduit for transporting the waste fabric from the clamps and for ejecting the waste fabric from the conduit into the waste collection station.

DESCRIPTION OF THE PREFERRED EMBODIMENT Organization

Figure 1:
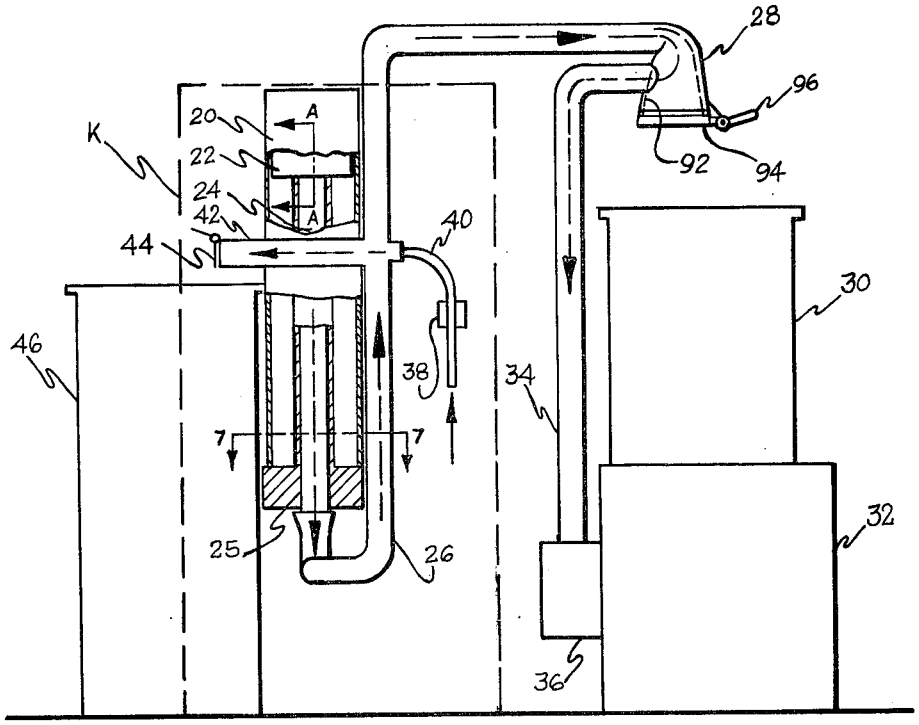
FIG. 1 is a front elevational view showing the general arrangement of the preferred embodiment of the present invention.

The preferred embodiment of this invention is included in a typical tubular circular knitting machine K as represented by the broken lines in FIG. 1, wherein a circular knitting head 20 is shown with a clamping and severing apparatus 22 located in the upper portion of the knitting head 20 and above the typical duct conduit 24 in which a knit stocking (not shown) is typically pendant during its formation by knitting head 20 while tensioned by a suction draft within the conduit 24. The operating mechanism 25 for the clamping and severing apparatus 22 is disposed below the knitting head 20 and extends upwardly for connection to the clamping and severing apparatus 22. The transport conduit 26, which is typically formed of clear plastic tubing is disposed below the conduit 24 in extending relation therefrom, first downwardly, then toward the front of the knitting machine K, then upwardly to a lateral portion thereof for connection to a stocking collection unit 28 which forms an outlet for deposit of stockings into a suitable contaner 30. A blower 32 for creating a suction is connected to the collection unit 28 by a suitable tube 34 through a control valve 36. A source of compressed air (not shown) is connected through a valve 38 and the tubing 40 to the upwardly extending portion of the transport conduit 26 to blow laterally across the transport conduit 26 through a horizontal tube 42 which is joined to, and forms an outlet from, the transport conduit 26, and the horizontal tube 42 has attached at its free end a lightly counter weighted pivoted sealing door 44. A suitable container 46 may be located under the door 44.

Structure

Figure 2:
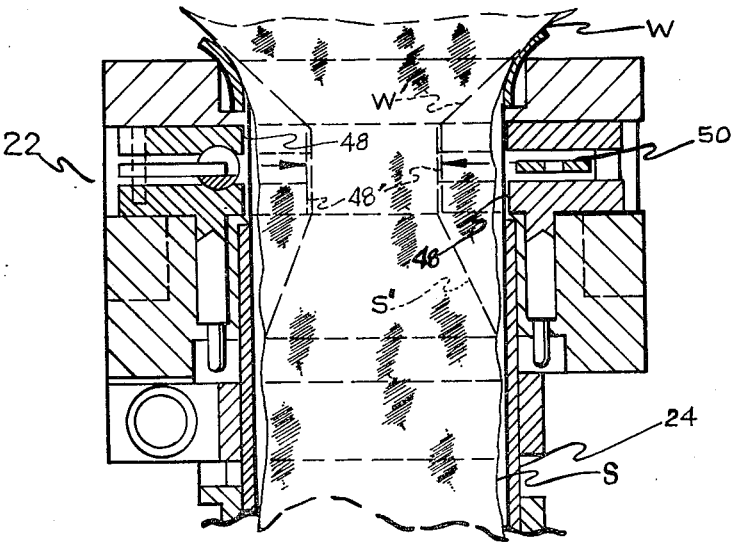
FIG. 2 is a vertical cross-section of the clamping, separating, and releasing portion of the apparatus located directly under the knitting head of the circular knitting machine taken along the line 2—2 of FIG. 1 wih the clamps fully open.
Figure 3:
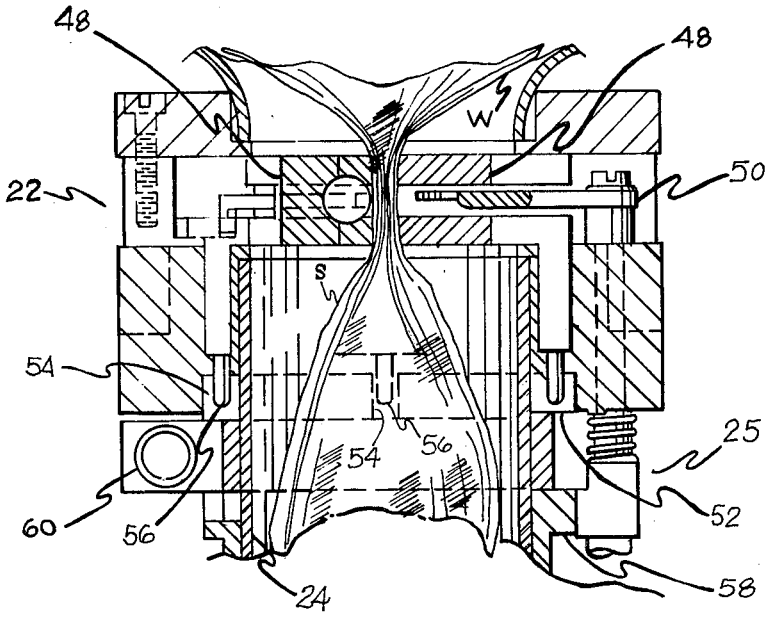
FIG. 3 is a vertical cross-section similar to FIG. 2 except that the clamps are fully closed on a stocking.
Figure 4:
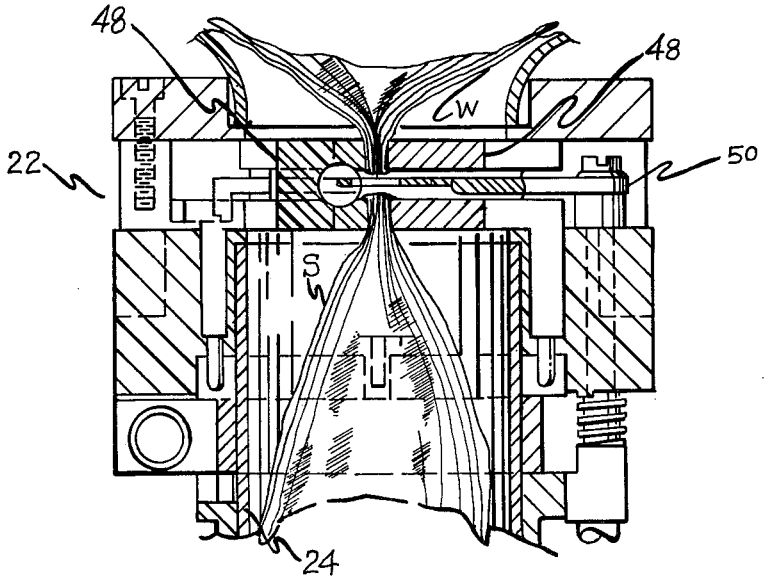
FIG. 4 is a vertical cross-section similar to FIG. 3 except that the hot element is shown having severed the stocking from the waste fabric.
Figure 5:
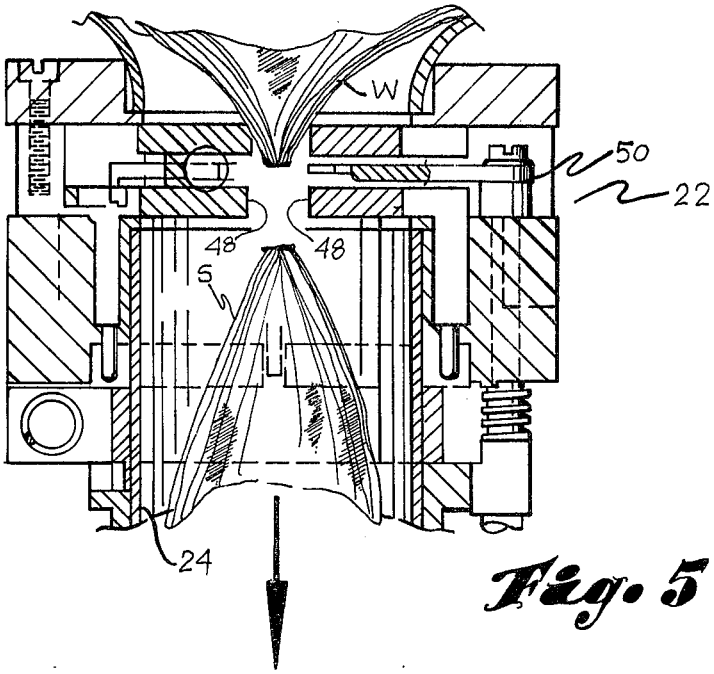
FIG. 5 is a vertical cross-section similar to FIG. 4 except that the clamp has partially opened to release the stocking.
Figure 6:
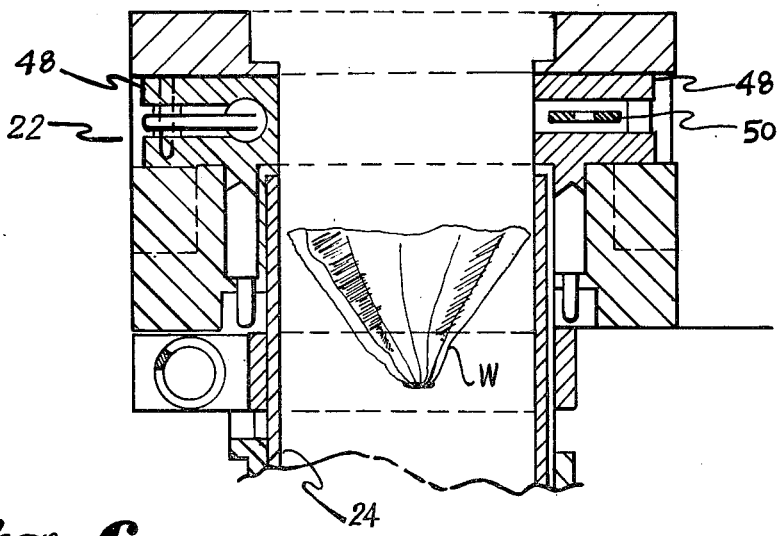
FIG. 6 is a vertical cross-section similar to FIG. 5 except that the clamp has opened fully to release the waste fabric to be transported therefrom.

FIG. 2 shows in solid lines the clamping and severing apparatus 22 in cross-section with the clamps 48 fully open and with the hot severing element or blade 50 shown withdrawn inside one of the clamps 48. A portion of a knit stocking S is shown hanging pendant from the knitting head 20 through the clamps 48 and into the conduit 24 below the waste fabric W, while the broken lines indicate the positions of stocking, waste fabric, and clamps at S', W', and 48' respectively, when the clamps 48 are partially closed. FIG. 3 shows the clamps 48 in fully closed position, and FIG. 4 shows the clamps 48 in fully close position and the severing blade 50 in severing position. FIG. 5 shows the clamps 48 in partially open position with the severing blade 50 withdrawn from severing position. FIG. 6 shows the clamps 48 fully open.

Figure 7:
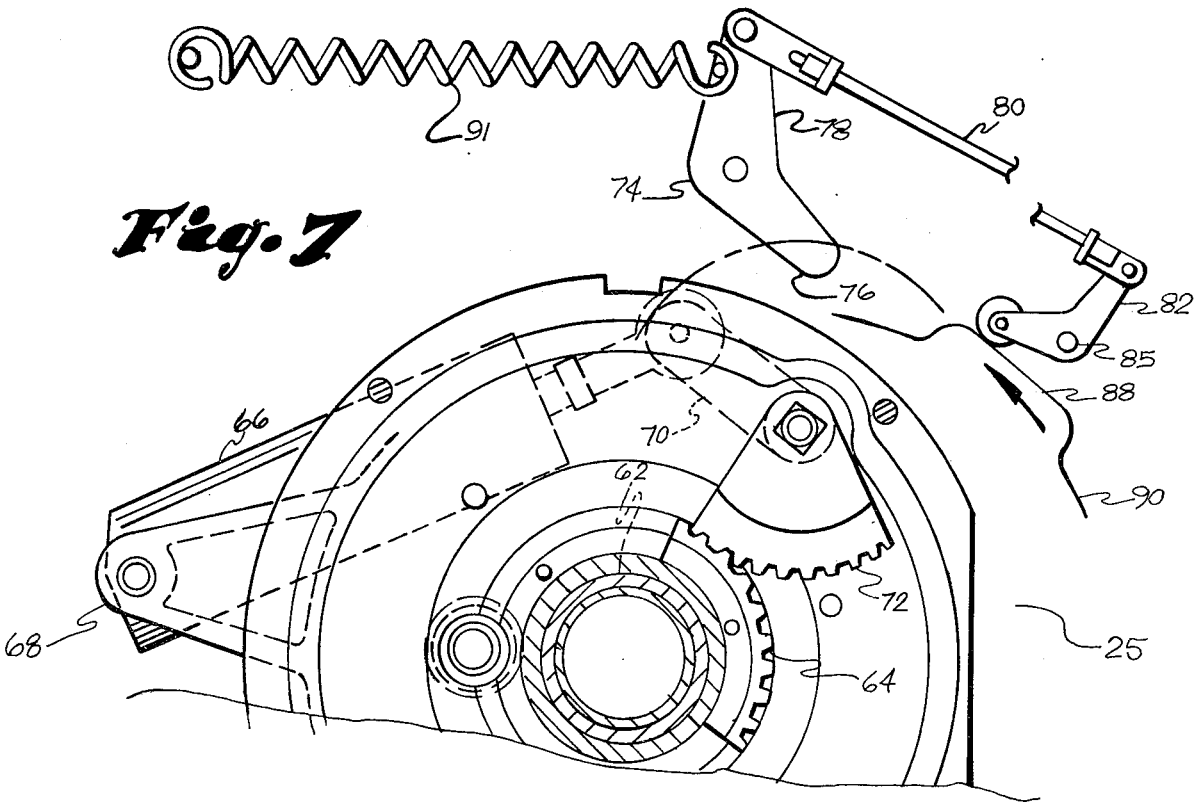
FIG. 7 is a horizontal cross-section taken approximately along the line 7—7 in FIG. 1 and showing a portion of the clamp operating apparatus.

The clamps 48 are moved to these various positions by the operating mechanism 25 through rotary movement about the conduit 24 of the slotted member 52 as shown in FIG. 3. The slots 54 engage the pins 56 which extend downwardly from the clamps 48 and thereby cause movement of the clamps 48 as has been fully disclosed in the Boyer U.S. Pat. No. 4,069,090. As also disclosed in the Boyer patent, the slotted member 52 derives its motion from the sleeve member 58 through the spring 60 while member 58 derives its motion from the extended hub 62 of the segment gear 64 (all included in operating mechanism 25) as shown in FIG. 7. Motion of the sleeve member 58 also controls the movement of the severing blade 50 as fully disclosed in the Boyer patent.

Referring to FIG. 7, a fluid cylinder 66 is pivotably attached to the stationary member 68 of the knitting machine K and has its piston rod end pivotably connected to the lever arm 70 of the gear sector 72 which is also pivotably mounted on the stationary member 68 for engagement of its gear teeth with the gear teeth of the segment gear 64. Gear 64 is mounted for rotary movement concentric with the conduit 24. Retraction of the piston rod of the cylinder 66 thereby causes clockwise rotation of the segment gear 64, and, through the operating mechanism 25, constriction of the clamps 48, and the opposite in reverse.

Figure 8:
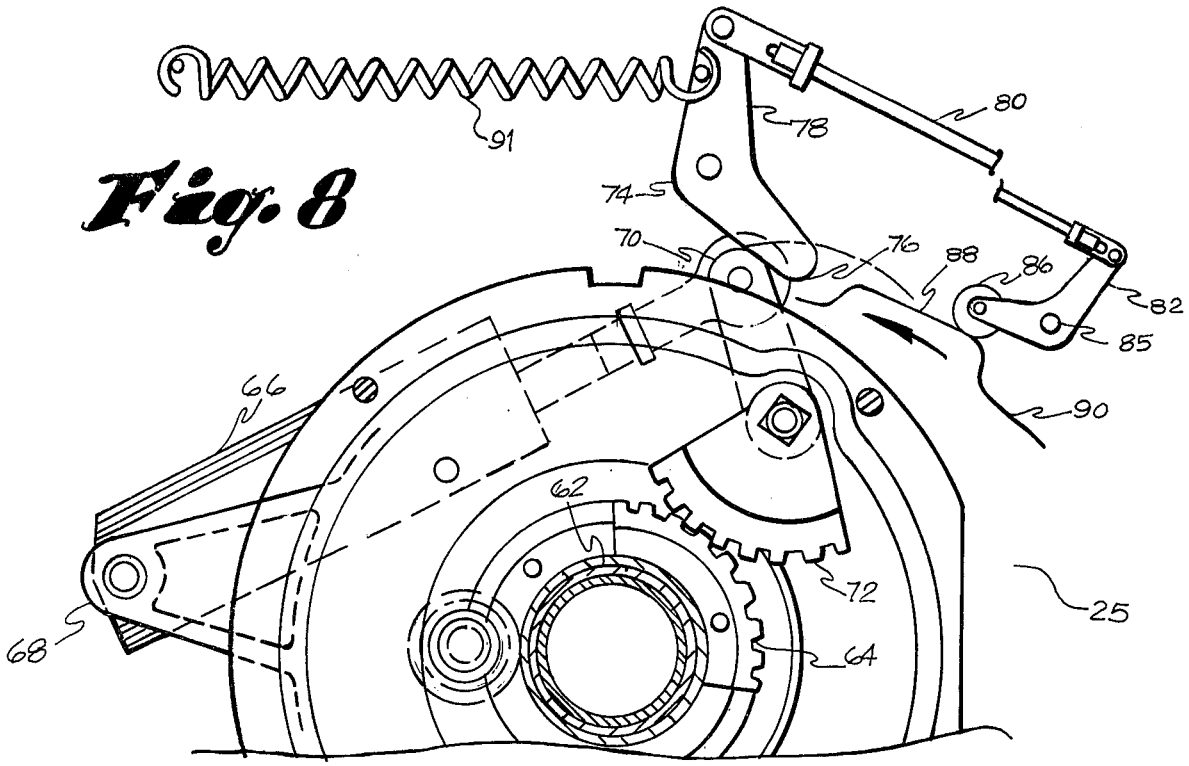
FIGS. 8 and 9 are similar to FIG. 7, but show the apparatus in configuration for partial and full opening of the clamps, respectively
Figure 9:
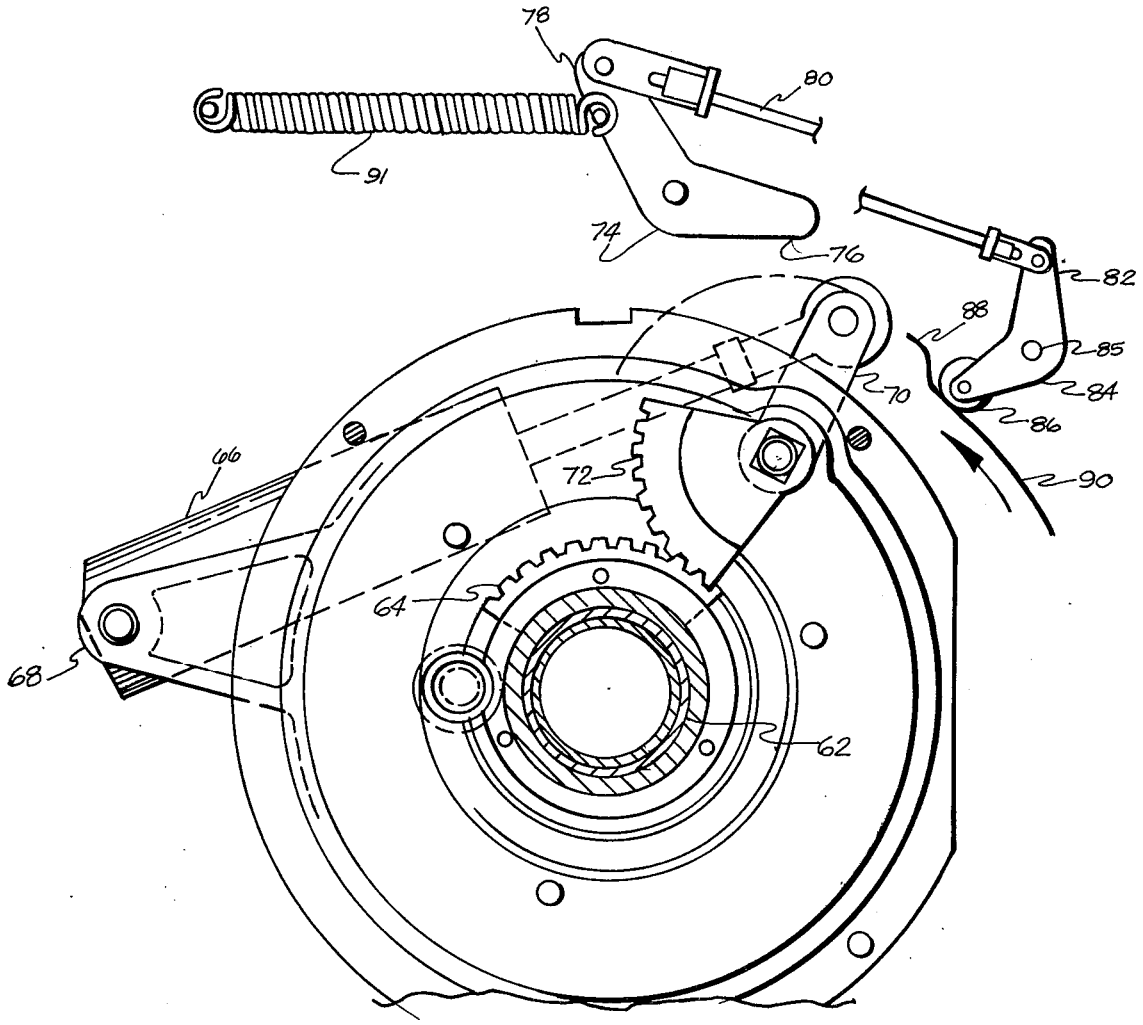

A stop arm 74 also pivotably mounted on the stationary member 68 has an extending end 76 disposed adjacent the path of travel of the lever arm 70 for selective engagement therewith to block the travel thereof. A crank end 78 of the stop arm 74 is connected by a cable 80 and suitable fittings to a bell crank 82 of a cam follower arm 84 which is pivotably mounted on a stud 85 to a stationary part of the knitting machine K and carries a cam follower 86 for engagement with a lobe 88 on a conventional control drum 90 of the knitting machine K for moving the stop arm 74 into position for blocking engagement with the lever arm 70 as shown in FIG. 8. Thus, the extension of the piston rod of the cylinder 66 may be stopped when the clamps 48 have opened only partially, typically about 6 mm. When he lobe 88 moves from under the follower 86, an extension spring 91 causes the retraction of the extending end 76 of the arm 70 so that the piston rod of the cylinder 66 may extend fully to position as shown in FIG. 9, causing the clamps 48 to open fully.

The aforementioned stocking collection unit 28 has an internal screen 92 through which the suction from the blower 32 is applied to the transport conduit 26, and a trap door 94, which is biased closed by a counterweight 96.

Operation

Figure 10:
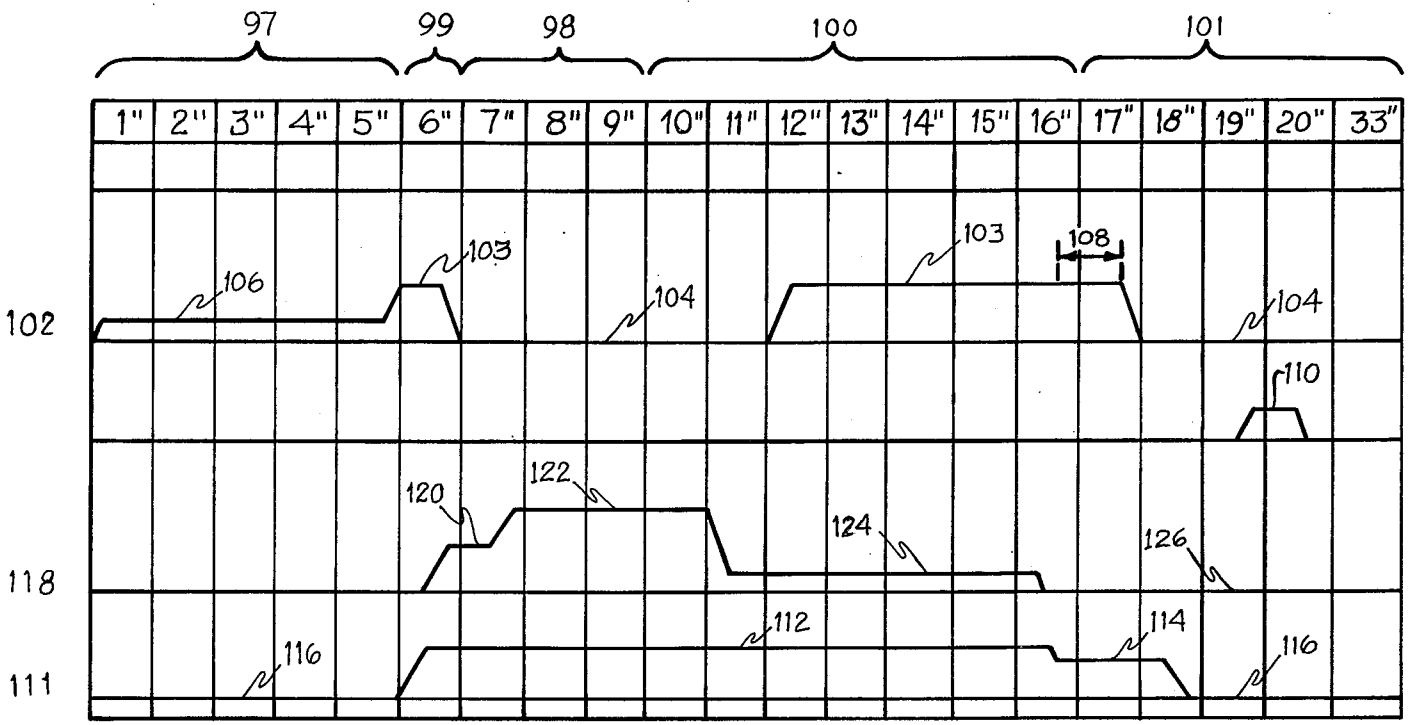
FIG. 10 is a diagrammatic illustration of the phase relations of the motions and functions for carrying out a toe end closure and the separation of the stocking and waste therefrom according to the present invention.

FIG. 10 is a diagrammatic illustration of the operations of the repetitive automatic cycle of the knitting head 20, the clamping and severing apparatus 22, and the suction within the transport conduit 26, to show the relationship of the various automatic functions and movements, all of which are controlled ultimately by the control drum 90 rotating at a constant rate. Working stages in the case of a stocking which is begun from the welt and finished with the closed toe according to the invention are shown on the abscissa of the diagram. The following stages are shown: 97—knitting of the toe; 98—withdrawal of the needles to finish the article; 99—knitting stopped; 100—beginning and forming of the welt; and 101—yielding of the welt by the hooks to the needles and knitting of the leg and foot—the whole cycle being carried out in approximately 33 seconds. The portion 102 of the diagram indicates the application of suction to the transport conduit 26 by the blower 32 as determined by the control valve 36 which is operated by a control cam on the control drum 90; the segment 103 corresponds to the application of suction as for transporting the stocking to the stocking collection unit 28; segment 104 corresponds to the interruption of suction; segment 106 corresponds to the tensioning suction; and segment 108 corresponds to the actual transport of the stocking. The segment 110 corresponds to a brief blast of compressed air from the tubing 40 across the transport conduit 26 as determined by the valve 38 which is controlled by a cam on the control drum 90.

The portion 111 indicates the condition of the clamps 48, wherein the segment 112 corresponds to the clamping of the stocking toe end by the clamps 48; the segment 114 corresponds to the partial opening of the clamps 48; and the segment 116 corresponds to the full opening of the clamps—all as determined by the cam on the control drum 90 which controls the fluid cylinder 66 and by the lobe 88 on the control drum 90 which controls the stop arm 74.

The portion 118 indicates the condition of the hot blade 50 wherein segment 120 indicates that the blade 50 is heated and extended for severing; segment 122 indicates that the blade 50 is extended and heated for sealing; segment 124 indicates that the blade 50 is still extended but heating is minimal while the sealed end of the thermoplastic stocking toe portion is cooled; and segment 126 indicates that the blade 50 is retracted with the clamps 48 while heating continues minimal.

In the usual method of operation of this invention, as diagrammed in FIG. 10 just explained, a knit stocking S has been completed and the toe end is positioned inside the clamping and severing apparatus 22 as shown in FIG. 2 while the toe, leg, and welt of the stocking S hang down within the conduit 24, and knitting has ceased as indicated by the numeral 99 in FIG. 10. At this time, to start the cycle, high suction is applied to the transport conduit 26, and thereby to the conduit 24, from the blower 32 while the clamps 48 are constricted to close on the toe end of the stocking S. Immediately after this radial constriction, the finished stocking is cast off the knitting needles (not shown) of the knitting head 20 and the "make-up" or start-up, of the welt of the next stocking begins in the knitting head 20.

The suction is cut off while the waste fabric W separately disposed above the toe end of the stocking is severed therefrom at the constriction thereof by the heated blade 50 and while the severed toe portion is closed by heat setting by continued heat from the blade 50 for a suitable period, at the end of which the blade 50 is retracted and suction is resumed on conduit 24. This suction draws air through the clamps 48 to cool the sealed toe end for a suitable period, near the end of which the clamps 48 are partially opened by reversing the clamping operation suitably only sufficiently to release the stocking S (but not sufficiently to release the separate waste fabric W which is retained above the clamps 48 by its unconstricted extremity which lies above its constricted heat sealed portion and above the clamps 48 and is considerably larger in its unconstricted condition than the opening through the only partially opened clamps 48 as shown in FIG. 5) to be advanced and sucked away from the clamping and severing operation for transport through the conduit 24 and conduit 26 to the screen 92 of the remotely located stocking collection unit 28. The released stocking S is held against the screen 92 until the suction is cut off, allowing the stocking S to drop down on the trap door 94 where it overbalances the counterweight 96 to fall into the container 30, after which the counter weight 96 closes the trap door 94 of the collection unit 28 for the next step in the cycle, where the clamps 48 are opened fully. This allows the entirety of the waste fabric W, already severed from the toe end of the stocking S and heretofore temporarily separate retained above the only partially opened clamps 48, to be released, advanced, and sucked away from the clamping and severing operation in fabric form for transport through conduits 24 and 26 by a suction draft created a short time after clamps 48 open by a brief blast of compressed air released by the valve 38 through the tubing 40 to form an air jet directed laterally across the conduit 26 and through the horizontal tube 42 toward the waste collection station formed by the waste container 46. When the released waste fabric W reaches the tube 42, it is instantly ejected from the conduit 26, through the tube 42, and past the sealing door 44 to drop into the container 46 for remote waste collection separate from the stocking collection unit 28.

The clamps 48 then remain open and suction on conduit 24 from blower 32 is resumed while knitting of the stocking S proceeds through the completion of the toe end and knitting again ceases, as indicated by the numeral 99 in FIG. 10, to complete a cycle. Thus, both stockings S and waste fabric W are drawn through the same conduit 26 by suction applied thereto, but they are discharged from different outlets on the conduit 26.

Thus, addition of the stop arm 74 with its associated apparatus, and horizontal tube 42 with its associated apparatus and compressed air, in novel configuration, make it possible to compound the qualitative advantages of separating the waste fabric W from the stockings S with the economic advantages of eliminating a manual sorting operation.

It should be understood that the present invention is susceptible to various modifications and adaptations, such as combination with other types of severing mechanisms, other types of toe closing operations and other equivalent variations. The particular embodiment disclosed in detail herein and illustrated in the drawings has been provided for disclosure purposes only and is not intended to limit the scope of the present invention, which is to be determined by the scope of the appended claims.

We claim:

1. A method of separating and collecting stockings and waste fabric severed therefrom, the stockings having thermoplastic toe portions, comprising:

(a) clamping a stocking at the toe portion thereof laterally in radial constriction immediately after the knitting thereof on a circular knitting machine, with the stocking depending from said toe portion and said waste fabric disposed thereabove, by closing constriction clamps;

(b) severing said toe portion from said waste fabric at said constriction with a heated blade that closes said toe portion by heat setting;

(c) partially opening said clamps to release said closed toe stocking while retaining said waste fabric thereat;

(d) transporting said closed toe stocking directly from said clamps through a conduit to a stocking collection location by means of a first suction draft through said conduit;

(e) fully opening said clamps to release said waste fabric; and (f) transporting said waste fabric directly from said clamps through a portion of said conduit and to a waste collection station by air means, said transporting through said portion of said conduit including applying a second suction draft, of said air means, therethrough and said transporting to said waste collection station including directing air of said air means laterally of said conduit through a lateral outlet therefrom disposed intermediate said clamps and said collection location for discharging said waste fabric from said conduit through said outlet to said waste collection station, said second suction draft being applied to said conduit at said outlet.

2. A method of separating and collecting stockings and waste fabric according to claim 1 and characterized further in that said discharging said waste fabric includes ejecting said waste fabric from said conduit into said waste collection station by said laterally directed air from an air jet directed laterally across said through said outlet toward said waste collection station.

3. A method of separating and collecting stockings and waste fabric according to claim 2 and characterized further in that said air jet directed across said conduit creates said suction draft in said portion of said conduit for said transporting said waste fabric from said clamps through said portion of said conduit.

4. Means for separating and collecting stockings and waste fabric severed therefrom, the stockings having thermoplastic toe portions, comprising;

(a) means for clamping a stocking at the toe portion thereof laterally in radial constriction immediately after the knitting thereof on a circular knitting machine, with the stocking depending from said toe portion and said waste fabric disposed thereabove, said means including constriction clamps;

(b) means for severing said toe portion from said waste fabric at said constriction and including a heated blade that closes the stocking toe end by heat setting;

(c) means for partially opening said clamps to release said stocking toe while retaining said waste thereat;

(d) first air means for transporting said closed toe stocking from said clamps and including a conduit and a first suction draft therethrough by which said stocking is transported directly to a stocking collection location;

(e) a lateral outlet from said conduit toward a waste collection station, said outlet being disposed intermediate said clamps and said collection location;

(f) means for fully opening said clamps to release said waste fabric; and (g) second air means for transporting said waste fabric directly from said clamps through a portion of said conduit and to a waste collection station, said second air means providing a second suction draft in said portion of said conduit for transporting said waste fabric through said portion of said conduit to said lateral outlet and providing air directed laterally of said conduit through said outlet toward said waste collection station for discharging said waste fabric from said conduit at said outlet therefrom into said waste collection station, said means suction draft being applied to said conduit at said outlet.

5. Means for separating and collecting stockings and waste fabric according to claim 4 and characterized further in that said laterally directed air is provided by air jet means directed laterally across said conduit toward said waste collection station and included in said second air means.

6. Means for separating and collecting stockings and waste fabric according to claim 5 and characterized further in that said air jet creates said second suction draft.

* * * * *

UNITED STATES PATENT OFFICE

CERTIFICATE OF CORRECTION

Patent No. 4,157,651 Dated June 12, 1979

Inventor(s) Sherrill B. Coggins et al

It is certified that error appears in the above-identified patent and that said Letters Patent are hereby corrected as shown below:

Column 1, line 66, after "waste" insert --fabric--. Column 2, line 9, delete "the entirety of." Column 2, line 10, before "waste," second occurrence, insert --entirety of the--. Column 2, line 12, delete "waste" and insert therefor --entirety--. Column 2, line 43, delete "separated" and insert therefor --separate--. Column 2, line 51, delete "from" and insert therefor --form--. Column 2, line 66, before "fabric" insert --waste--. Column 3, line 32, delete "wih" and insert therefor --with--. Column 4, line 33, delete "close" and insert therefor --closed--. Column 5, line 11, delete "he" and insert therefor --the--. Column 5, line 15, after "to" insert --the--. Column 6, line 48, delete "separate" and insert therefor --separately--. Column 8, line 2, after "said" insert --conduit--. Column 8, line 46, delete "means" and insert therefor --second--.

Signed and Sealed this

*Twentieth* Day of *May 1980*

[SEAL]

*Attest:*

SIDNEY A. DIAMOND

*Attesting Officer*

*Commissioner of Patents and Trademarks*